United States Patent [19]

Beale et al.

[11] Patent Number: 4,544,878

[45] Date of Patent: Oct. 1, 1985

[54] SWITCHED CURRENT MIRROR

[75] Inventors: Richard G. Beale, Freehold, N.J.; Apparajan Ganesan, Indianapolis, Ind.

[73] Assignee: AT&T Bell Laboratories, Murray Hill, N.J.

[21] Appl. No.: 538,946

[22] Filed: Oct. 4, 1983

[51] Int. Cl.[4] ..... G05F 3/20

[52] U.S. Cl. ..... 323/315; 323/316

[58] Field of Search ..... 323/315, 316, 317; 307/313, 451; 324/83 R

[56] References Cited

U.S. PATENT DOCUMENTS

| | | | |
|---|---|---|---|
| Re. 29,910 | 2/1979 | Ahmed | 323/315 |
| 4,001,731 | 1/1977 | Van Sluys | 323/317 |
| 4,262,221 | 4/1981 | Dingwell | 307/313 |
| 4,359,649 | 11/1982 | Mündel | 307/290 |

*Primary Examiner*—Peter S. Wong

*Assistant Examiner*—Judson H. Jones

*Attorney, Agent, or Firm*—Volker R. Ulbrich

[57] ABSTRACT

The input (16) and output (20) MOS transistors of a current mirror (10) have their sources connected to a supply voltage node (12). The gate of the input transistor (16) is connected to its drain and is also connected to the gate of the output transistor (20) through an isolation switch (24). The gate of the output transistor (20) is connected to the supply voltage node (12) through a disable switch (26). Closing of the disable switch (26) and opening of the isolation switch (24) turns off current in the output transistor (20). Opening the disable switch (26) and closing the isolation switch (24) turns the output current on again.

Also disclosed is a mirror (28) having switches (30), (32) configured for various logic functions. A voltage-controlled oscillator (34) and a phase detector circuit 72 having a switched current input provided by switched current mirrors (40, 42, 80, 82) is described.

8 Claims, 4 Drawing Figures

SWITCHED CURRENT MIRROR

TECHNICAL FIELD

The present invention relates generally to electronic switching circuits and more particularly to current switching integrated circuits which selectively enable or inhibit current flow in response to a signal voltage.

BACKGROUND OF THE INVENTION

Current switching circuits selectively enable or inhibit current flow in response to a signal voltage. Some circuits, e.g. phase detectors and voltage controlled oscillators, require highly accurate current switching circuits for their input. In these applications the accuracy and settling time of the output current is particularly critical.

Present current switching circuit arrangements typically involve the switching or steering of a predetermined current between two branches. Such an arrangement may be too limited in its speed, due to the required charging time for resistors and parasitic capacitances. Also, the output current actually flows through the switching devices. As a result, there is significant current leakage in both the branch carrying current and the branch from which the current was switched. This leakage is not entirely predictable for a given circuit and therefore can effect the accuracy of the output. Moreover, because of voltage drops across the switching devices, dynamic range is sacrificed. Finally, switching the current from one branch to another is likely to result in switching transients which add directly to the output current. These increase the time required for validation of the output signal.

SUMMARY OF THE INVENTION

The current switching circuit in accordance with the present invention is in the form of a switched current mirror. An input transistor has its conduction path connected between an input current source and a supply voltage node. An output transistor has its conduction path connected between a load and the supply voltage node. The control electrode of the input transistor is connected to its conduction path side remote from the supply voltage node. It is also connected to the control electrode of the output transistor through an isolation switch. The control electrode of the output transistor is connected to a shut-off voltage, such as the supply voltage node, through a disable switch. The closing of the the disable switch and opening of the isolation switch selectively turns off the output current through the output transistor and thereby enables switching of the output current. The switching process has no significant adverse transient effect on the output current. Because the switches carry no steady-state current, they do not degrade the accuracy or the dynamic range of the basic current mirror configuration.

DETAILED DESCRIPTION

In the circuits described below, the transistors are enhancement mode field-effect transistors. The electronic switches are preferably transmission gates which are each a parallel complementary pair of MOS (metal-oxide-semiconductor) transistors so arranged to minimize switching charge feedthrough. The gate of the P-type transistor of the pair is addressed through an inverter. Such transmission gates are known in the art and are therefore not discussed in detail.

Figure 1:
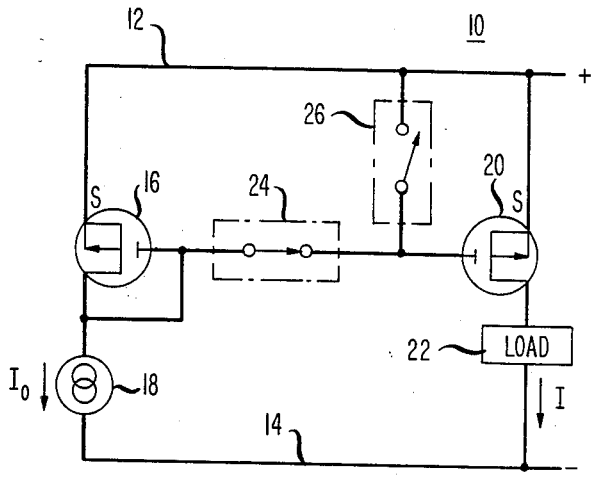
FIG. 1 is a schematic circuit diagram of a switched current mirror in accordance with one example of the present invention.

One example of the invention is the current mirror 10 shown in FIG. 1 of the drawings. An input current branch carrying an input current $I_O$ and an output current branch carrying an output current I are connected in parallel between a positive supply voltage node 12 and a negative supply voltage node 14. The input current branch includes a P-channel input transistor 16 which has its source connected to the positive supply node 12. A current source 18 is connected between the negative supply voltage node 12 and the drain of the input transistor 16. The output branch includes a P-channel transistor 20 which has its source connected to the positive supply node 12. An output load 22 is connected between the drain of the output transistor 20 and the negative supply node 14. The gate of the input transistor 16 is connected to its drain. It is also selectively connected to the gate of the output transistor 20 through an isolation switch 24. The gate of the output transistor 20 is selectively connected to the positive supply node 12 as a shut-off voltage through a disable switch 26. The term "shut-off voltage" as used herein refers to any gate voltage which results in loss of conduction in the conduction path of the transistor.

In the operation of the switched current mirror 10 the switches 24, 26 are operated by a pair of switching pulses $T_1$, $T_2$, respectively, which have corresponding durations $T_1$, $T_2$. They inherently complement each other and in the preferred design have no overlap, so that all the isolation switches open before any of their complementary disable switches close, and all the disable switches open before their complementary isolation switches close. For understanding the operation of the current mirror 10, it is useful to initially consider the condition in which both switches 24, 26 are in the position above. In this condition it is readily apparent that due to the nature of the current mirror configuration, the input branch current $I_O$ and the output branch current I will be equal if the input transistor 16 and the output transistor 20 have identical device geometries. Known fixed ratios can be determined for the input and output currents $I_O$ and I by appropriate scaling of the device geometries. When it is now desired to switch off the output current I, the disable switch 26 is first closed by the switching pulse $T_2$. Simultaneous therewith, or immediately thereafter, the isolation switch 24 is opened by the switching pulse $T_1$. The connection of the gate of the output transistor 20 to the positive supply node 12 by the switch 26 discharges the voltage on the gate of transistor 20, thereby turning off the output current I. The opening of the isolating switch 24 prevents the input branch current from being shunted around the input transistor 16 and thereby having its current flow disrupted. If it is now desired to turn the output current I on again, the disable switch 26 is first opened by the pulse $T_2$ and then, simultaneously therewith or immediately thereafter, the isolation switch 24 is closed to connect together the gates at the input and output transistors 16, 20. Again it is seen that there is no significant change in the input branch current flow, except for that required to charge the gate of transistor 20. Because the gate of the output transistor 20 draws no steady state current, there is no current flow through the switches 24, 26. Consequently, the switches 24, 26 have no adverse effects on the operation of the current mirror 10. This results in an output current I that is very accurately controlled. Furthermore, because there is no current steering, the switching of the output current I can be performed very rapidly.

Figure 2:
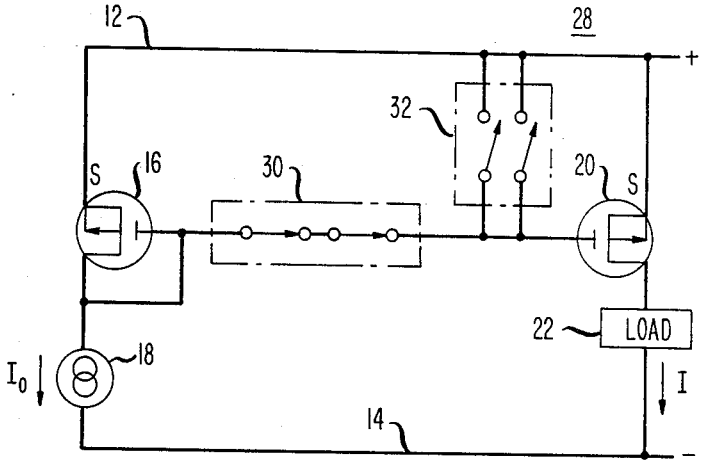
FIG. 2 is a schematic circuit diagram of a switched current mirror in accordance with another example of the present invention which includes a logic function incorporated in the switches.

In FIG. 2, there is shown another example of the invention in the form of a current mirror 28 which is in most respects identical with the mirror 10 of FIG. 1 and in which corresponding elements are identified by the same reference symbols as in FIG. 1. The mirror 28, however, has an isolation switch 30 and a disable switch 32 which are complex and can define various logic functions with respect to the output current, such as AND, NAND, OR, and NOR. In the mirror 20, the switches 30, 32 are connected in an AND configuration. Such logic functions are useful in certain types of circuits, as will be described in an example below.

Figure 3:
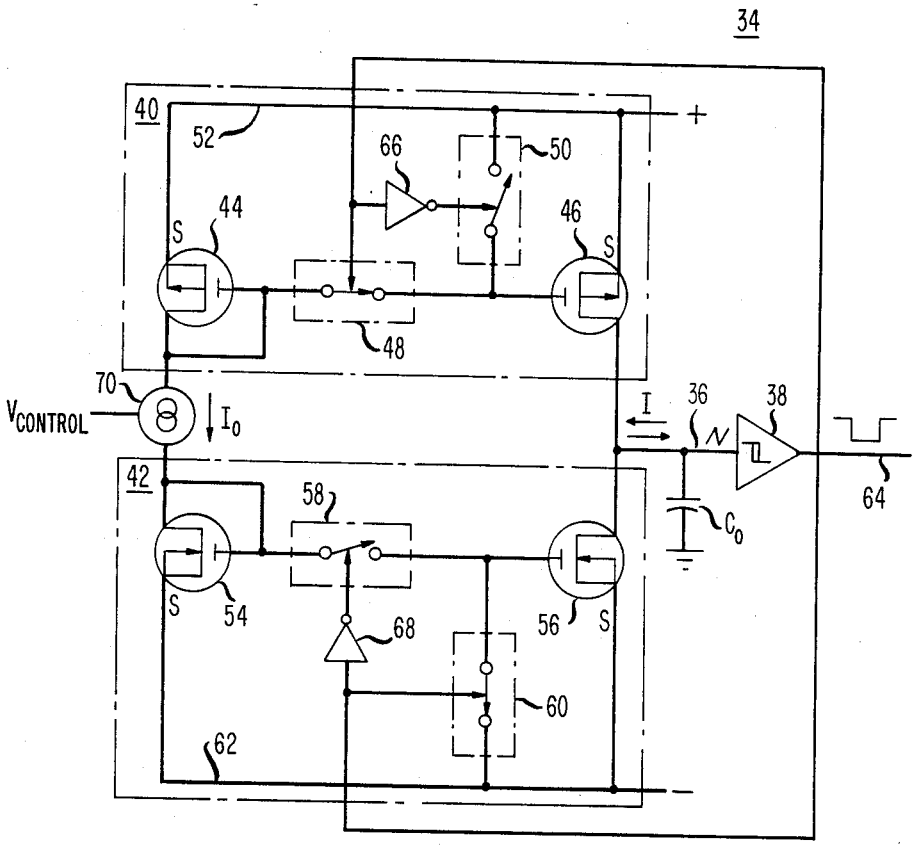
FIG. 3 is a schematic circuit diagram of a voltage controlled oscillator in accordance with a third example of the invention which includes the switched current mirror of FIG. 1.

A third example of the invention is the voltage controlled oscillator 34 shown in FIG. 3. The oscillator 34 includes a capacitor $C_O$ connected between ground potential and the input node 36 of a Schmitt trigger 38. The input to the Schmitt trigger 38 is provided by a complementary configuration of two switched current mirrors 40, 42 which are similar to the current mirror 10 of FIG. 1. The upper current mirror 40 includes an P-channel input transistor 44, a P-channel output transistor 46, an isolation switch 48, and a disable switch 50. The sources of the transistors 44, 50 are connected to a positive voltage node 52. The lower current mirror 42 includes an N-channel input transistor 54, an N-channel output transistor 56, an isolation switch 58, and a disable switch 60. The sources of the transistors 54, 56 are connected to a negative supply voltage node 62. The upper isolation switch 48 and the lower disable switch 60 are operated directly from the output node 64 of the Schmitt trigger 38. The upper disable switch 50 and the lower isolation switch 58 are operated from the output node 64 of the Schmitt trigger 38 through inverters 66, 68, respectively, which in effect provide a complement of the Schmitt trigger 38 output.

The voltage controlled oscillator 34 is shown in the condition which represents a high output state of the Schmitt trigger 38. When the output state of the Schmitt trigger 38 is low, the switches 48, 50, 58, 60 will be in their alternate positions. A current source 70, the value of which is controlled by a voltage $V_C$ is connected between the drains of the input transistors 44, 54 and determines the input branch current. The output transistors 46, 56 can be switched on and off by their respective switches 48, 50, 58, 60 to result in a switched output current I in either direction at the input node 36 of the Schmitt trigger 38. Since the charging rate of the capacitor $C_O$ is determined by the magnitude of the switched current I, the value of the input branch current as determined by the current source 70 controls the oscillating frequency of the voltage controlled oscillator 34.

It is a particularly advantageous feature of the oscillator 34 that the accuracy of the switched current $I_{OUT}$ for the input node 36 of the Schmitt trigger 38 is determined by the device geometry ratios of the transistors 44, 46, 54, 56. This can be very accurately and reliably determined without significant variation from wafer to wafer in production. The Schmitt trigger 38 may itself also be designed to depend entirely on device geometry ratios and a reference voltage, as described in copending application (Beale Case 1–2), thereby making it possible, using existing transconductance technology to realize an oscillator 34 with an accuracy dependent entirely on device geometry ratios. There are known techniques for realizing accurate transconductance making use of a timing reference.

Figure 4:
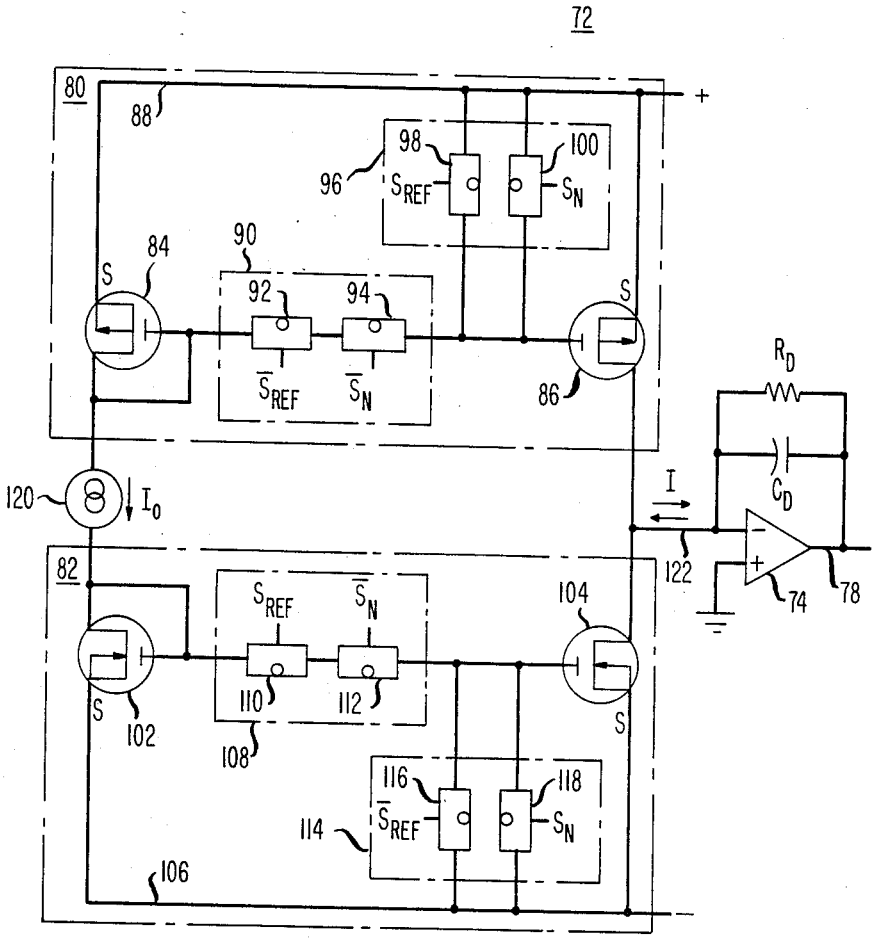
FIG. 4 is a schematic circuit diagram of a phase detector circuit in accordance with a fourth example of the invention which includes a switched current mirror with logic functions incorporated in its switches.

A third example of the invention is the phase detector 72 of FIG. 4. A low-pass filter output section for the circuit 72 includes an operational amplifier 74 having inverting (−) and noninverting (+) input ports and an output port 78. The noninverting input port (+) is connected to ground potential. A resistor $R_D$ and a capacitor $C_D$ are connected in parallel between the output port 78 and the inverting input port as feedback elements. A switched current I is provided to the inverting input port (−) by a phase detector formed by a complementary arrangement of two switched current mirrors 80, 82. These are configured in much the same way as the mirrors 40, 42 of the voltage controlled oscillator 34 of FIG. 3, but have switching logic, as in the mirror 28 of FIG. 2. The upper current mirror 80 includes P-channel input and output transistors 84, 86 associated with a positive supply voltage node 88. An isolation switch 90 is made up of two transmission gates 92, 94 in series. A disable switch 96 is made up of two transmission gates 98, 100 in parallel. A lower current mirror includes N-channel input and output transistors 102, 104 which have their sources connected to a negative supply voltage node 106. An isolation switch 108 is made up of two transmission gates 110, 112. A disable switch 114 is made up of two transmission gates 116, 118. The drains of the input transistors 84, 102 are connected to each other through a current source 120, which establishes an input branch current $I_O$. The drains of the output transistors 86, 104 are connected together to form an output current node 122 which is capable of supplying a bidirectional current.

In the operation of the phase detector circuit 72 the switches 90, 96, 108, 114 are operated by control voltage obtained from two signals of which phase detection is desired. Typically this would be a reference signal $S_{ref.}$ which is usually generated by a local oscillator and an input signal $S_N$ with an unknown phase and frequency relationship to the reference signal $S_{ref.}$. The two signals $S_{ref.}$, $S_N$ are applied to the transmission gates 92, 94, 98, 100, 110, 112, 116, 118 as is indicated in the figure. When the control voltage for a transmission gate is high, the gate is conducting. When the voltage is low, the gate is in non-conducting. The notation used in the figure indicates that a control voltage with a bar over it is the opposite state of the control voltage without a bar. Thus, if $S_{ref.}$ is high, $\overline{S}_{ref.}$ is low. It is readily seen that when the two signals $S_{ref.}$ and $S_N$ have the same frequency and are completely in phase, the magnitude of the d.c. current at the output node 122 will be maximized. The output of the phase detector varies linearly over a range of phase difference from −90° to +90°. It is an advantageous feature of the phase detector circuit 72 that a loss of the input signal results in a so-called "tri-state" operation. That is, both transistors 86 and 104 are shut off.

General Considerations

The switches of a current mirror in accordance with the invention may be transmission gates, as in the phase detector circuit 72 above, or may be some other suitable electronic switching devices. Moreover, the transistors need not be field-effect transistors; they may be bipolar, with appropriate circuit adaptations. Current mirror configurations which use bipolar transistors are well known. Other current mirror configurations, such as cascode arrangements, can be used with appropriate switching circuitry instead of the simple mirror arrangements described above to obtain even better switched current mirror performance.

It is noted that by using the output of a voltage controlled oscillator, such as the oscillator 34 in FIG. 3, for supplying the reference signal $S_{ref.}$ for the phase detector circuit 72 of FIG. 4, it is possible to construct a phase lock loop arrangement which has its loop characteristics determined entirely by device geometry ratios and therefore can be accurately defined.

The isolation and disable switches of current mirrors in accordance with the invention can have various logic configurations other than those described above. There may be three or more isolation switches in series, with a corresponding number of disable switches in parallel. For some purposes it may also be desirable to have a parallel arrangement of isolation switches and/or a series arrangement of disable switches.

What is claimed is:

1. An electronic circuit, comprising:

an input transistor having a conduction path and a control electrode therefor, one side of its conduction path being connected to its control electrode and the other side of its conduction path being connected to a supply voltage node;

an output transistor having a conduction path and a control electrode therefor, one side of its conduction paths being connected to the supply voltage node;

first means adapted to selectively connect and disconnect the output transistor control electrode from a shut-off voltage source, and second means adapted to selectively connect and disconnect the output transistor control electrode from the input transistor control electrode.

2. The circuit defined in claim 1, wherein said first and second means comprise electronic switches configured for various logic functions.

3. An electronic circuit, comprising:

a first input and a first output transistor having one side of their conduction paths connected to a first supply voltage node, the control electrode of the first input transistor being connected to the other side of its conduction path;

first isolation switch means for selectively connecting together the control electrodes of the first input and first output transistors;

first disable switch means for selectively connecting the control electrode of the first output transistor to a first shut-off voltage source;

a second input and a second output transistor having one side of their conduction paths connected to a second supply voltage node, the control electrode of the second input transistor being connected to the other side of its conduction path, the other sides of the conduction paths of the first and second output transistors being connected together to form an output current node;

second isolation switch means for selectively connecting together the control electrodes of the second input and second output transistors;

second disable switch means for selectively connecting the control electrode of the second output transistor to a second shut-off voltage source, and current source means connected between the other side of the conduction paths of the first and second input transistors.

4. The circuit defined in claim 3, comprising:

a capacitor connected at one side to the output current node and connected at its other side to a reference potential;

a Schmitt trigger with its input port connected to the one side of the capacitor, and means for operating the isolation and disable switches in response to the output of the Schmitt trigger.

5. The circuit defined in claim 4, wherein one of the isolation switch means and one of the disable switch means have their control leads connected to the output of the Schmitt trigger, and the other disable switch means and the other isolation switch means have their control leads connected to a complement of the output of the Schmitt trigger.

6. The circuit defined in claim 2, wherein said first means comprises a pair of switches connected in parallel between the control electrode of the output transistor and the shut-off voltage source, and the second means comprises a pair of switches connected in series between the control electrode of the input transistor and the control electrode of the output transistor.

7. The circuit defined in claim 6 wherein the first and second means are configured for a phase detection function.

8. The circuit defined in claim 7, comprising:

an amplifier having an inverting input port connected to the output current node, a noninverting input port connected to a reference potential, and an output port, and a capacitor and a resistor connected in parallel between the output port and the inverting input port of the amplifier.

* * * * *